US009091988B2

(12) United States Patent
Nakase

(10) Patent No.: US 9,091,988 B2
(45) Date of Patent: Jul. 28, 2015

(54) IMAGE FORMING APPARATUS CAPABLE OF IMAGE CALIBRATION

(75) Inventor: Takahiro Nakase, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 402 days.

(21) Appl. No.: 12/546,154

(22) Filed: Aug. 24, 2009

(65) Prior Publication Data

US 2010/0054775 A1 Mar. 4, 2010

(30) Foreign Application Priority Data

Aug. 27, 2008 (JP) ..... 2008-217888
Jul. 1, 2009 (JP) ..... 2009-157026

(51) Int. Cl.
*G03G 15/00* (2006.01)

(52) U.S. Cl.
CPC ..... *G03G 15/5062* (2013.01); *G03G 15/5037* (2013.01); *G03G 2215/00755* (2013.01); *G03G 2215/0164* (2013.01)

(58) Field of Classification Search
CPC ..... G03G 15/5037; G03G 15/5062
USPC ..... 399/49, 45, 301, 298, 48, 299, 302, 303
See application file for complete search history.

(56) References Cited

U.S. PATENT DOCUMENTS 5,566,372 A 10/1996 Ikeda et al. ..... 355/208
5,943,526 A * 8/1999 Kodama ..... 399/66
5,978,615 A * 11/1999 Tanaka et al. ..... 399/49
6,785,480 B2 * 8/2004 Toyohara et al. ..... 399/49
2001/0019418 A1 * 9/2001 Kataoka et al. ..... 358/1.12
2003/0129006 A1 * 7/2003 Hoshi et al. ..... 399/298
2005/0019048 A1 1/2005 Kato
2006/0188277 A1 * 8/2006 Nishida et al. ..... 399/49
2007/0242986 A1 * 10/2007 Matsuyama et al. ..... 399/301
2010/0330475 A1 * 12/2010 Tamoto et al. ..... 430/56

FOREIGN PATENT DOCUMENTS

JP 04062576 A * 2/1992
JP 06-311365 A 11/1994
JP 7-264411 10/1995
JP 10-333393 A 12/1998

(Continued)

OTHER PUBLICATIONS

Translation: JP2005-092001A to Iritono et al., Apr. 2005.*

(Continued)

*Primary Examiner* — Quana M Grainger
(74) *Attorney, Agent, or Firm* — Fitzpatrick, Cella, Harper & Scinto

(57) ABSTRACT

An image forming apparatus includes first and second image forming devices each including a rotatable drum, a charging device, an exposure device, and a developing device, each of the image forming devices being configured to form an image on a sheet; a gradation pattern forming device for forming a first gradation pattern on a sheet by the first image forming device and forming a second gradation pattern on the sheet by the second image forming device; a density detecting device for detecting a density of the gradation patterns; a correcting device for correcting an image forming condition of each of the image forming devices; and a potential detecting device, selectively provided to the first image forming device, capable of detecting potential in order to adjust the potential of the drum.

4 Claims, 12 Drawing Sheets

(56) References Cited

FOREIGN PATENT DOCUMENTS

| | | | | |
|---|---|---|---|---|
| JP | 2000242056 | A | * | 9/2000 |
| JP | 2000242057 | A | * | 9/2000 |
| JP | 2003-066683 | A | | 3/2003 |
| JP | 2005-025159 | A | | 1/2005 |
| JP | 2005092001 | A | * | 4/2005 |
| JP | 2006-133358 | A | | 5/2006 |

OTHER PUBLICATIONS

Translation: JP06-311365A to Washio, Apr. 1994.*

Office Action in Japanese Patent Application No. 2009-157026, mailed Feb. 26, 2014.

* cited by examiner

IMAGE FORMING APPARATUS CAPABLE OF IMAGE CALIBRATION

FIELD OF THE INVENTION AND RELATED ART

The present invention relates to an image forming apparatus, for forming an image electrostatically, such as a printer, a copying machine, or a facsimile machine.

An image output by the image forming apparatus and an image which has been intended, by a user, to be output by the image forming apparatus produce differences depending on an environment, status of use, and the like of the image forming apparatus.

For that reason, in order to output the image which has been actually intended to be output by the image forming apparatus, an image quality stabilizing method which is called calibration is employed.

Specifically, first, images stepwisely different in density are output on a sheet by the image forming apparatus. Then, the images output on the sheet are read by using an original reading apparatus such as a scanner. Based on the read image, the image forming apparatus changes an image forming condition so that a quality of the image approximates that of the image intended, by the user, to be output by the image forming apparatus.

The calibration is described specifically in Japanese Laid-Open Patent Application No. Hei 7-264411, wherein an image forming apparatus is configured to output a color image by developing electrostatic images formed on a single photosensitive member by using a plurality of developing devices.

In recent years, an image forming apparatus of a tandem type wherein a color image is formed by developing electrostatic images formed on a plurality of photosensitive members by using associated developing devices, respectively, has been on the market.

Such an image forming apparatus of the tandem type includes a combination of a photosensitive member and a developing device (hereinafter referred to as a station) different for each of colors. For that reason, when a white/black (monochromatic) image is output frequently as in offices, a black station is worn earlier than other stations.

For that reason, with respect to products for offices which are considered that use frequency of the black station is high, there is a concept that only the black station is improved in durability in order that exchange frequency of the black station is substantially equal to those of other (yellow, magenta, cyan) stations.

Thus, when the durability of the black station is improved, the following problem arises. For example, a high-durability station effects printing on a large number of sheets until the durability of the station reaches its limit. For that reason, there is a high possibility that electric potential at a drum surface fluctuates depending on a level of the durability. When the surface potential fluctuates depending on the durability level, there arises a problem of deterioration in image quality. For that reason, such an image forming apparatus that a potential sensor is provided only to the black station to stabilize the image quality is considered.

In such an image forming apparatus that the potential sensor is provided only to the black station, the calibration is performed by outputting tone gradation patterns as shown in FIG. 12 on a sheet. In this case, however, when a position of the black tone gradation pattern formed on the sheet and a position of a potential sensor on a photosensitive drum are deviated from each other, there has arisen such a problem that correction accuracy of an image density is lowered when an image forming condition is changed on the basis of a density of the output black tone gradation pattern.

SUMMARY OF THE INVENTION

A principal object of the present invention is to solve the above-described problems.

According to an aspect of the present invention is to provide an image forming apparatus comprising:

first and second toner image forming means each including a rotatable photosensitive member, charging means for electrically charging the photosensitive member, exposure means for exposing the charged photosensitive member to light depending on image information, and developing means for developing with toner an electrostatic image formed on the photosensitive member, each of the first and second toner image forming means being configured to form an image on a sheet;

tone gradation pattern forming means for forming a first tone gradation pattern on a sheet by the first toner image forming means and forming a second tone gradation pattern on the sheet by the second toner image forming means;

density detecting means for detecting a density of the first and second tone gradation patterns formed on the sheet;

correcting means for correcting an image forming condition of each of the first and second toner image forming means depending on an output of the density detecting means; and potential detecting means, selectively provided to the first toner image forming means from the first and second toner image forming means, capable of detecting potential of a part of a potential detecting area of the photosensitive member with respect to a rotational axis direction of the photosensitive member in order to adjust the potential of the photosensitive member;

wherein the tone gradation pattern forming means forms the first tone gradation pattern on the sheet so that at least a part of the first tone gradation pattern corresponds to the potential detecting area and forms the second tone gradation pattern on the sheet so as not to overlap the first tone gradation pattern.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
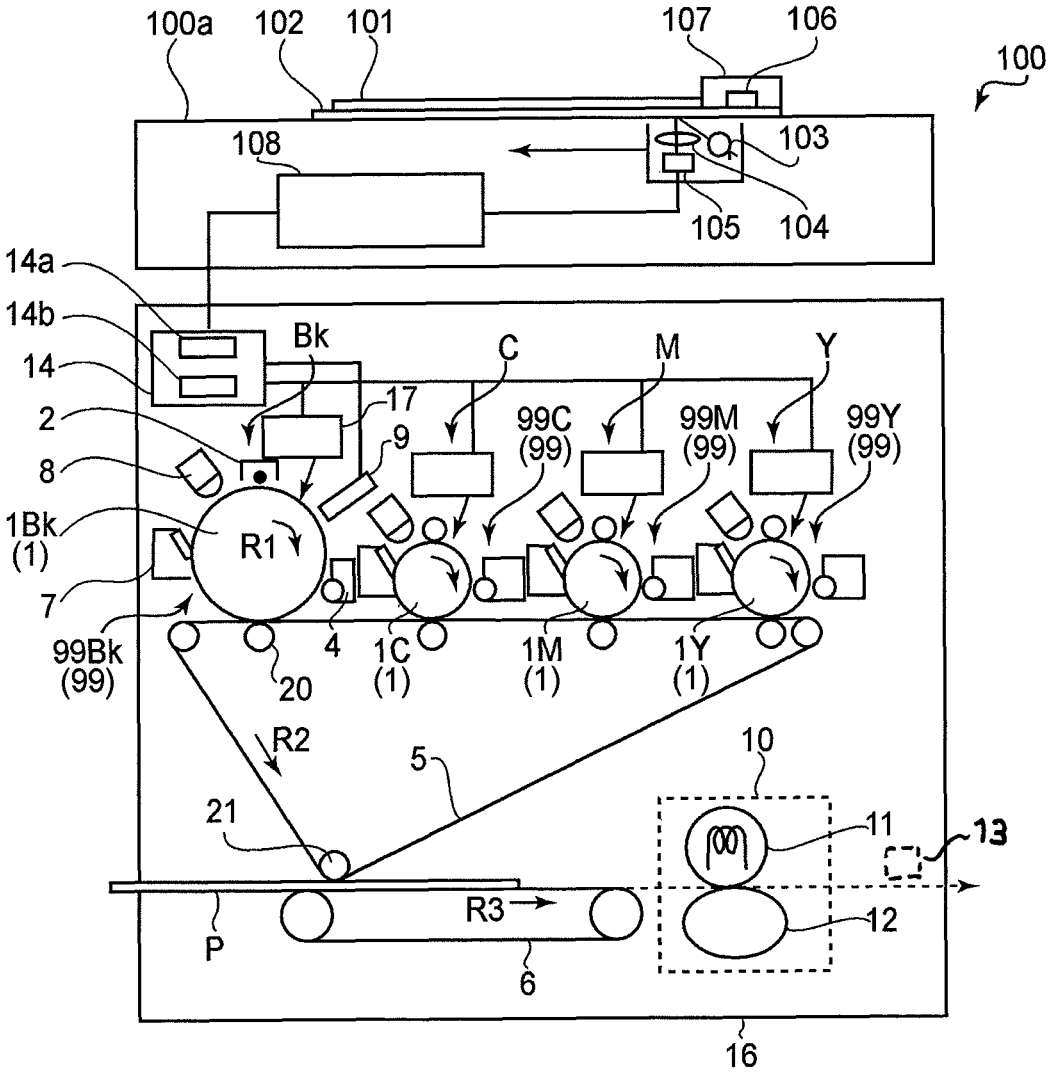
FIG. 1 is a sectional view showing a structure of an image forming apparatus according to an Embodiment of the present invention.

Hereinbelow, Embodiments of the present invention will be described with reference to the drawings. Incidentally, in the respective drawings, members or means indicated by identical reference numerals or symbols have the same constitutions or functions, thus being appropriately omitted from redundant explanation.

Figure 10:
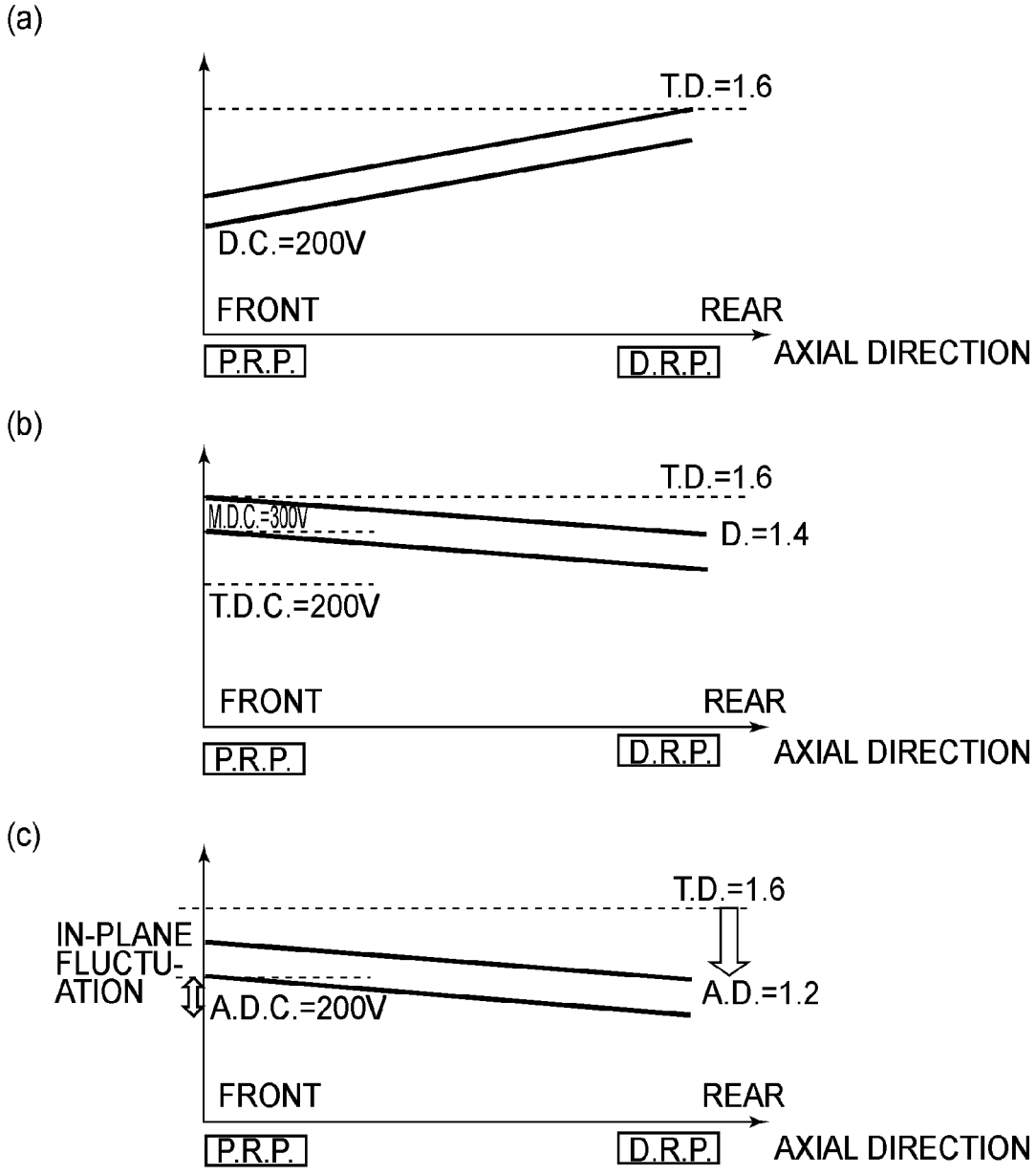
FIGS. 10(*a*) to 10(*c*) are graphs with respect to a conventional image forming apparatus, wherein FIG. 10(*a*) is a graph showing a relationship between an image pattern density and a developing contrast with respect to a position of an axial direction of a photosensitive drum in the case where the density condition deriving means is controlled, FIG. 10(*b*) is a graph showing a relationship between the image pattern density and the developing contrast with respect to the position of the axial direction of the photosensitive drum in the case where the potential is changed with time or the like, and FIG. 10(*c*) is a graph showing a relationship between the image pattern density and the developing contrast with respect to the position of the axial direction of the photosensitive drum in the case where the image density adjusting means is controlled.

Here, the above-described problems to be solved by the present invention will be explained in detail based on specific conventional examples. FIG. 10(*a*) is a graph showing a density of an adjusting image pattern and a developing contrast of a photosensitive drum with respect to a position of an axial direction of the photosensitive drum in the case where an image forming condition is controlled by a density condition deriving means (controller).

As shown in FIG. 10(*a*), in the case where the image forming condition is controlled by the density condition deriving means, it is assumed that the potential of a photosensitive drum for black is upwardly inclined from left to right. In the figure, a left-hand side of an abscissa is a front side of an image forming apparatus and a right-hand side of the abscissa is a rear side of the image forming apparatus.

In this image forming apparatus, on the front side of the photosensitive drum, a potential reading position (P.R.P.) in which a potential sensor detects the potential is provided. Further, on the rear side of the photosensitive drum, an adjusting image pattern to be detected by a density detecting means (e.g., a scanner) is formed. The adjusting image pattern formed on the photosensitive drum is read by the scanner.

For example, a target density (T.D.) of an image to be output on a sheet is set at 1.6. In this case, a toner image formed on the sheet on the rear side of the photosensitive drum is read by the scanner. At this time, the controller controls a charging condition so that the density is realized at a density reading position (D.R.P.). That is, a developing contrast (D.C.) (=developing DC voltage component-exposure portion potential) of 200 V detected by the potential sensor is stored.

When the image forming condition is determined by the density condition deriving means, the developing contrast is 200 V on the front side but is 300 V on the rear side, so that the density is set at 1.6 on the rear side, thus being of no problem.

FIG. 10(*b*) is a graph showing a relationship between the image pattern density and the developing contrast of the photosensitive drum with respect to the position of the axial direction of the photosensitive drum when a state is changed by a change in potential with time or the like. As shown in FIG. 10(*b*), in the case where a charging device is exchanged due to deterioration or in the case where the user effects continuous formation of images different in image ratio with respect to the axial direction for a long period by the image forming apparatus, it is assumed that the potential of the photosensitive drum for black is downwardly inclined left to right. In this case, a measured developing contrast (M.D.C.) is 200 V. As described above, it is judged that the developing contrast is required to be 200 V when the target density is 1.6. As a result, the potential is judged to be required to be lowered.

FIG. 10(*c*) is a graph showing a relationship between the image pattern density and the developing contrast of the photosensitive drum with respect to the position of the axial direction of the photosensitive drum when the image forming condition is controlled on the basis of the image density adjusting means. In the above-described state, as shown in FIG. 10(*c*), in the case where control using the potential is automatically effected, the control is made so that the potential is further adjusted to be lowered so as to realize the developing contrast of 200 V at the potential reading position by the potential sensor. As a result, the potential at the density reading position on the rear side is further lowered, so that there has arisen such a problem that a desired density cannot be ensured in the entire area with respect to the axial direction of the photosensitive drum.

Further, when a charging roller is used and the potential sensor is not provided, potential non-uniformity with respect to a rotational direction occurs on the photosensitive drum. This is because the charging roller is a rotatable member, so that a dynamic fluctuation of an electric discharge area due to surface shape non-uniformity or eccentricity of the charging roller with respect to the rotational direction, electric discharge non-uniformity due to resistance non-uniformity, and non-uniformity of a charging/photosensitive property of the photosensitive drum are caused to occur. In this situation, when the adjustment is effected by using the adjusting image pattern changed in density with respect to the rotational direction, such a problem that accuracy is lowered when a relationship between the developing contrast and the density is obtained occurs.

FIG. 1 is a sectional view showing a structure of an image forming apparatus 100 according to an Embodiment of the present invention. As shown in FIG. 1, the image forming apparatus 100 is of an electrophotographic type and FIG. 1 illustrates a schematic structure of a principal portion of the image forming apparatus 100.

The image forming apparatus 100 is a full-color machine, thus including stations for respective colors of Y (yellow), M (magenta), C (cyan), and Bk (black). In each of the stations, image forming portions 99 as a toner image forming means are disposed. The image forming portions 99 includes an image forming portion 99Bk for black (Bk) as a first image forming portion which is a first toner image forming means and further includes, as a second image forming portion which is a second toner image forming means, an image forming portion 99Y for yellow (Y), an image forming portion 99M for magenta (M), and an image forming portion 99C for cyan (C). Each of the image forming portions 99Bk, 99Y, 99M, and 99C includes a drum-type electrophotographic photosensitive member (hereinafter referred to as a "photosensitive drum") 1. With respect to the photosensitive drum 1, a photosensitive drum 1Bk for black (Bk) as a first photosensitive member is employed. Further, as a second photosensitive member, a photosensitive drum 1Y for yellow (Y), a photosensitive drum 1M for magenta (M), and a photosensitive drum 1C for cyan (C) are employed. However, constitutions common to all the photosensitive drums are representatively described below by using the photosensitive drum 1. The photosensitive drum 1 is supported inside a main assembly 16 of the image forming apparatus 100 so as to be rotatably in a direction of an arrow R1 (in a clockwise direction in FIG. 1).

When white/black (monochromatic) printing is performed by the image forming apparatus 100, the photosensitive drums for colors of Y, M and C are moved away from an intermediary transfer belt (not shown). At this time, rotation of the photosensitive drums for colors is stopped. For that reason, the photosensitive drums for colors are not worn at the time of the white/black printing. In order to make the durability of the black image forming portion 99Bk and the durability of the color image forming portions substantially equal to each other, the photosensitive drum of the black image forming portion 99Bk has a diameter larger than those of the photosensitive drums of the color (yellow, magenta, cyan) image forming portions.

Specifically, the diameter of the photosensitive drum of the black image forming portion 99Bk is 80 mm and the diameter of the photosensitive drums of the color image forming portions is 50 mm. Incidentally, a surface layer thickness of the photosensitive drum of the black image forming portion 99Bk may be larger than those of the photosensitive drums of the color image forming portions. Further, surface hardness of the photosensitive drum affecting a lifetime of the photosensitive drum may also be changed. That is, the thickness of the photosensitive drum for black (black photosensitive drum) may be made larger than those of the photosensitive drums for colors (color photosensitive drums). Further, the surface harness of the black photosensitive drum may also be made larger than those of the color photosensitive drums. The surface hardness is Moh's hardness. In the present invention, the photosensitive drums of the color image forming portions are an organic photosensitive member (OPC) and the photosensitive drum of the black image forming portion is an organic photosensitive member (OPC) which has been subjected to electron beam curing treatment.

Further, in this embodiment, as the charger for charging the black photosensitive drum, a non-contact charger is used. Specifically, as the non-contact charger, a corona charger is used for charging the photosensitive drum surface. As the chargers for charging the color photosensitive drums, a contact charger is used. Specifically, as the contact charger, a charging roller is brought into contact with the photosensitive drum to charge the photosensitive drum surface.

Around the photosensitive drum 1, a charging device 2 as a charging means, an exposure device 17 as an exposure means, a potential sensor 9 as a potential detecting means, a developing device 4 as a developing means, a cleaning device 7 as a cleaning means, and a pre-exposure device 8 as a pre-exposure means are disposed in this order along a rotational direction of the photosensitive drum 1.

The potential of the black photosensitive drum surface is subjected to feed-back control by using the potential sensor 9 included in the black image forming portion. That is, an image forming controller 14 controls a voltage to be applied to the corona charger as the non-contact charger so that the photosensitive drum surface potential detected (obtained) by the potential sensor 9 coincides with a target potential.

The color image forming portions do not include the potential sensor. For that reason, the surface potentials of the color image forming portions are controlled by using known electric discharge current control.

Incidentally, the charging roller as the contact charger contacts the photosensitive drum. For that reason, principally due to eccentricity of the charging roller, charging non-uniformity is liable to occur with respect to a circumferential direction of the photosensitive drum.

Inside the image forming apparatus main assembly 16, an inner transfer unit 5 as a transfer means which contacts each station at a first transfer portion 20 and rotates in a direction of an arrow R2 is disposed. Further, inside the image forming apparatus main assembly 16, an outer transfer belt 6, which contacts the inner transfer unit 5 at a second transfer portion 21 and rotates in a direction of an arrow R3 at a sheet passing portion, is disposed. A fixing portion including a fixing roller 11 and a pressing belt 12 is disposed close to an end of the sheet passing portion at which the sheet is conveyed by the outer transfer belt 6.

In the image forming apparatus 100, during image formation, the photosensitive drum 1 is rotationally driven about a rotational shaft (not shown) at a predetermined process speed in a direction of an arrow R1. The surface of the photosensitive drum 1 is uniformly charged to a predetermined polarity and a predetermined potential by the charging device 2. A photosensitive drum potential at this time is taken as a charge potential (non-exposed portion (dark portion) potential) VD.

In the exposure device 17, a tone gradation pattern as image information based on an image signal sent from the image forming controller 14 is outputted in the form of light emitted from a laser chip provided inside the exposure device 17 with an exposure amount designated by the image forming controller 14. The surface of the charged potential is irradiated with scanning light. At the irradiation portion, electric charges held on the surface of the photosensitive drum 1 by the charging are removed to form a removal latent image. The photosensitive drum potential at this time is taken as an exposure portion (light portion) potential VL.

Onto the resultant electrostatic image on the density 1, toner is flown and deposited when a developing bias is applied to a developing sleeve as a toner carrying member provided inside the developing device 4. In the case where a DC component of the developing bias is taken as Vdc and a potential difference between Vdc and the exposure portion VL is taken as a developing contrast Vcont, the amount of the toner subjected to development is increased with a larger Vcont. A toner image formed by the development is transferred from the photosensitive drum 1 onto the inner transfer unit 5 at the first transfer portion 20 and then is transferred from the inner transfer unit 5 onto a sheet P at the second transfer portion 21. The toner image is subjected to thermal compression bonding to the sheet P.

Inside the image forming apparatus 100 of the present invention, the potential sensor 9 is located on the rear side with respect to an axial direction (a shaft direction) of the photosensitive drum 1 and is located between a light irradiation position by the exposure device 17 and a position in which the developing device 4 is disposed. The potential sensor 9 measures the surface potential of the photosensitive drum 1. Specifically, the potential sensor 9 is capable of measuring the exposure portion potential VL in the case where the exposure is performed and capable of measuring the charge potential VL as the non-exposed portion potential in the case where the exposure is not performed.

In the present invention, of the above-described first toner image forming means and second toner image forming means, the potential sensor 9 is selectively provided to the first toner image forming means.

Above the image forming apparatus main assembly 16, an original reading apparatus 100*a* as a density detecting means is provided. An original 101 placed on an original supporting platen glass 102 is irradiated with light emitted from a light source 103 and the light is focused on a CCD sensor 105 through an optical system 104. The CCD sensor 105 generates color component signals of red, green and blue for associated CCD line sensors for red, green and blue arranged in 3 lines. The reading optical system unit scans the original 101 in a direction of an indicated arrow to convert data of the original 101 into electric signal data column for each line. The original reading apparatus 100*a* as the density detecting means detects the density of an adjusting tone gradation pattern 50 Bk for black as a first tone gradation pattern formed on the sheet P. Further, the original reading apparatus 100*a* detects each of densities of adjusting tone gradation patterns 50Y, 50M and 50C for yellow, cyan and magenta, respectively, as a second tone gradation pattern formed on the sheet P.

On the original supporting platen glass 102, an abutment member 107 against which the original 101 is abutted to prevent oblique placement of the original 101. Further, on the surface of the original supporting platen glass 102, a reference white plate 106 for determining a white level of the CCD sensor 105 and for effecting shading of the CCD sensor with respect to a thrust direction is disposed.

The image signal obtained by the CCD sensor 105 is image-processed by a reader image processing portion 108 and then is further image-processed by the image forming controller 14. The reader image processing portion 108 has the function of detecting the density of an image developed by the developing device 4.

The image forming controller 14 as a tone gradation pattern forming means includes a density condition deriving means 14*a* and an image density correcting means 14*b* as a correcting means. The image forming controller 14 forms the black adjusting tone gradation pattern 50Bk as the first adjusting tone gradation pattern by the black image forming portion 99Bk. The image forming controller 14 forms the yellow adjusting tone gradation pattern 50Y as the second adjusting tone gradation pattern by the yellow image forming portion 99Y. The image forming controller 14 forms the magenta adjusting tone gradation pattern 50M as the second adjusting tone gradation pattern by the magenta image forming portion 99M. The image forming controller forms the cyan adjusting tone gradation pattern 50C as the second adjusting tone gradation pattern by the cyan image forming portion 99C. The image forming controller 14 forms the black adjusting tone gradation pattern 50Bk as the first tone gradation pattern with respect to the sheet conveyance direction so that at least a part of the black adjusting tone gradation pattern 50Bk corresponds to a potential detecting area of the potential sensor 9.

Further, the image forming controller 14 forms the yellow adjusting tone gradation pattern 50Y, the magenta adjusting tone gradation pattern 50M, and the cyan adjusting tone gradation pattern 50C so that these patterns 50Y, 50M and 50C do not overlap with the black adjusting tone gradation pattern 50Bk.

The density condition deriving means 14*a* derives a density condition from the converted density by the original reading apparatus 100*a* of the adjusting tone gradation pattern as the tone gradation pattern described later, a high voltage set during output of the adjusting tone gradation pattern, an exposure condition, and the measured potential of the black photosensitive drum 1Bk.

The image density correcting means 14*b* effects adjustment, with respect to the black (Bk), so as to provide a desired Vcont by adjusting at least one of the charging device 2 and the exposure device 17 while detecting the exposure portion potential with the potential sensor 9. Further, with respect to the cyan (C), the magenta (M) and the yellow (Y), the image density correcting means 14*b* permits output at a desired density by adjusting at least one of high voltage conditions for the charging device 2 and the developing device 4 and the exposure condition for the exposure device 17. Thus, the image density correcting means 14*b* corrects an image forming condition for the black image forming portion 99Bk as the first toner image forming means depending on an output of the original reading apparatus 100*a* as the density detecting means. Further, the image density correcting means 14*b* corrects image forming conditions for the yellow image forming portion 99Y, the magenta image forming portion 99M, and the cyan image forming portion 99C as the second toner image forming means depending on outputs of the original reading apparatus 100*a* as the density detecting means.

Figure 2:
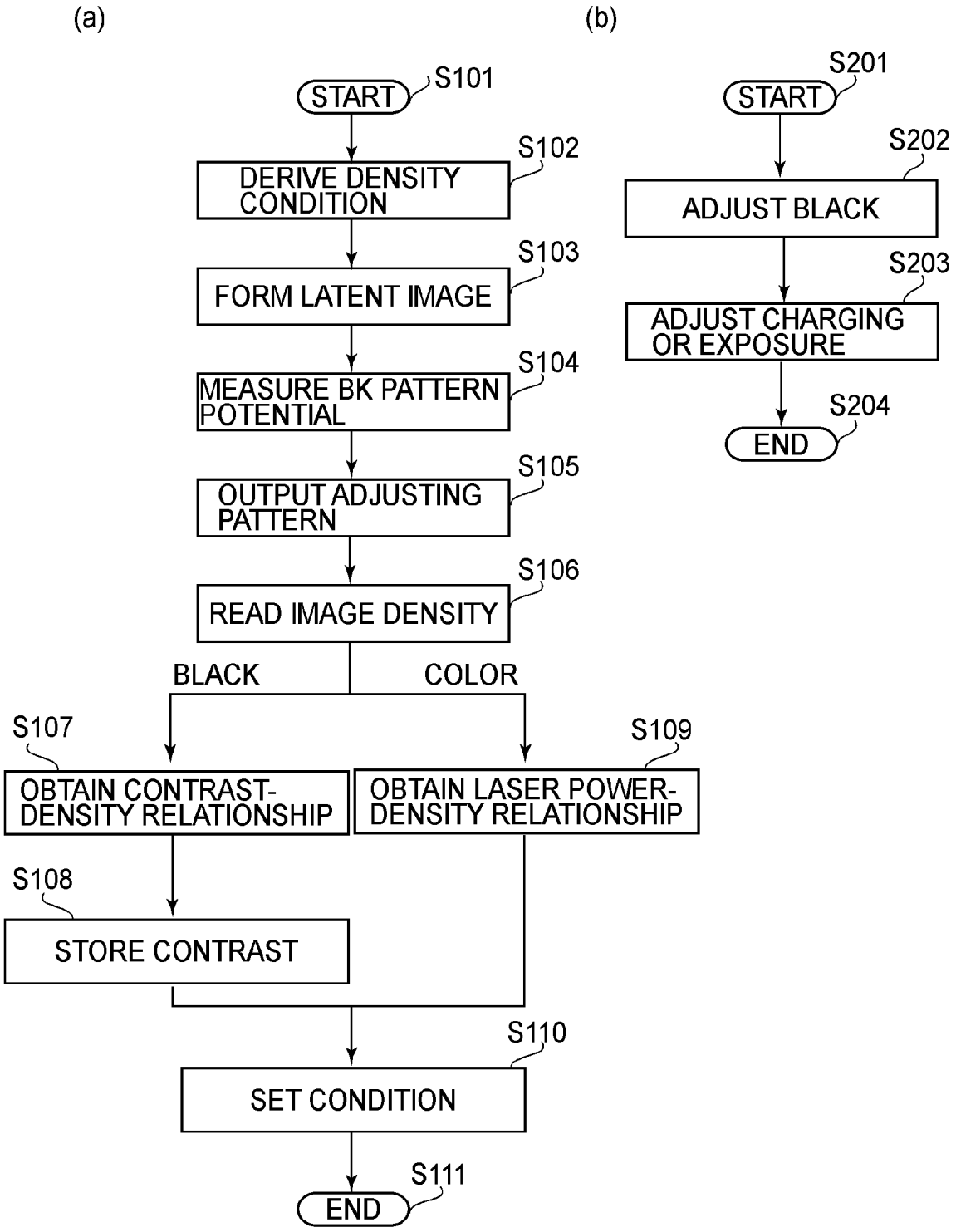
FIG. 2(*a*) is a flow chart showing control of a density condition deriving means and FIG. 2(*b*) is a flow chart showing control of an image density adjusting means (image density correcting means).

FIG. 2(*a*) is a flow chart showing control by the density condition deriving means 14*a*. As shown in FIG. 2(*a*), the density condition deriving means 14*a* is actuated (S (step) 101). By user's instruction, the density condition deriving means 14*a* starts the control (S102). The density condition deriving means 14*a* forms the adjusting tone gradation pattern in the form of the latent image on the photosensitive drum 1 by changing the conditions for the charging, the development, and the exposure (S103). The density condition deriving means 14*a* causes the potential sensor 9 to measure the potential of the black photosensitive drum 1Bk with respect to the black portion of the adjusting tone gradation pattern and stores the measured potential (S104). In this case, the potential sensor 9 measures the potential of the black photosensitive drum 1Bk at the time of being charged by the charging device 2 and the potential of the black photosensitive drum 1Bk at the time of being exposed to light by the exposure device 17 (S104). Then, the density condition deriving means 14*a* subjects the adjusting tone gradation pattern to development, transfer, and fixation to output the adjusting tone gradation pattern (S105). The density condition deriving means 14*a* urges the user to place the adjusting tone gradation pattern, instructed by the user to output, on the original reading apparatus 100*a* and the density of the adjusting tone gradation pattern is read by the reader image processing portion 108 (S106).

The image reading of the adjusting tone gradation pattern may also be performed in the following manner without using the original reading apparatus 100*a*. For example, a CCD sensor 13 can be provided between the fixing device 10 and a sheet discharge portion (for discharging the sheet to the outside of the image forming apparatus) with respect to the conveyance direction of the sheet P and is configured to automatically read the adjusting tone gradation pattern image after the fixation. In this case, the CCD sensor functions as the density detecting means. Incidentally, before the tone gradation pattern for image adjustment is formed on the sheet, adjustment such that the dark portion potential (VD) of the photosensitive drum 1 is a target value may be performed.

Figure 5:
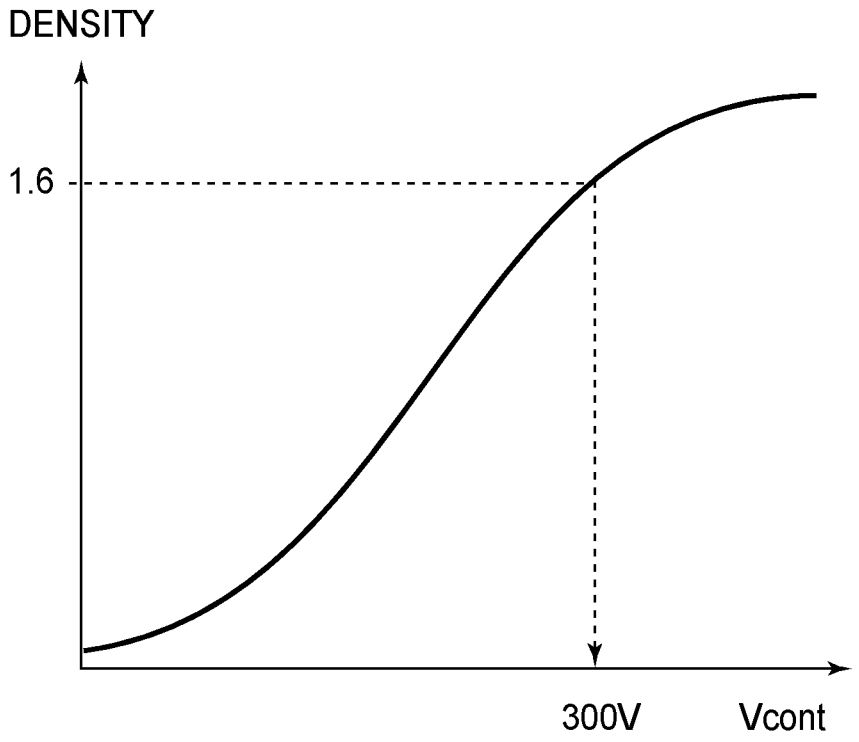
FIG. 5 is a graph showing a relationship between the developing contrast (Vcont) and the density.

At the black station, the developing contrast Vcont is calculated from the measured potential VL stored in S104 and the set developing bias Vdc and then a relationship between the developing contrast and the density as shown in FIG. 5 is obtained in combination with the density read in S106 (S107). In this embodiment, the charge potential VD is −600 V and the developing bias Vdc is −450 V. The potential VL is changed from −50 V to −450 V by changing the exposure light amount, so that the developing contrast Vcont is changed from 400 V to 0 V. In this case, with respect to the developing contrast, the potential of the adjusting tone gradation pattern is directly read, so that it is possible to accurately determine a necessary developing contrast without being influenced by potential non-uniformity with respect to the rotational direction due to charging non-uniformity by eccentricity of the photosensitive drum or due to sensitivity non-uniformity of the photosensitive layer with respect to the rotational direction. When the image forming apparatus 100 adjusts the density to 1.6 as an intended value, the developing contrast Vcont obtained from the relationship shown in FIG. 5 is 300 V, so that the image forming controller 14 stores the Vcont of 300 V (S108). Thereafter, until the adjustment in the present invention is performed, automatic density adjustment is performed in accordance with the above-described conventional adjusting method to adjust the density (S110 and S111).

Figure 11:
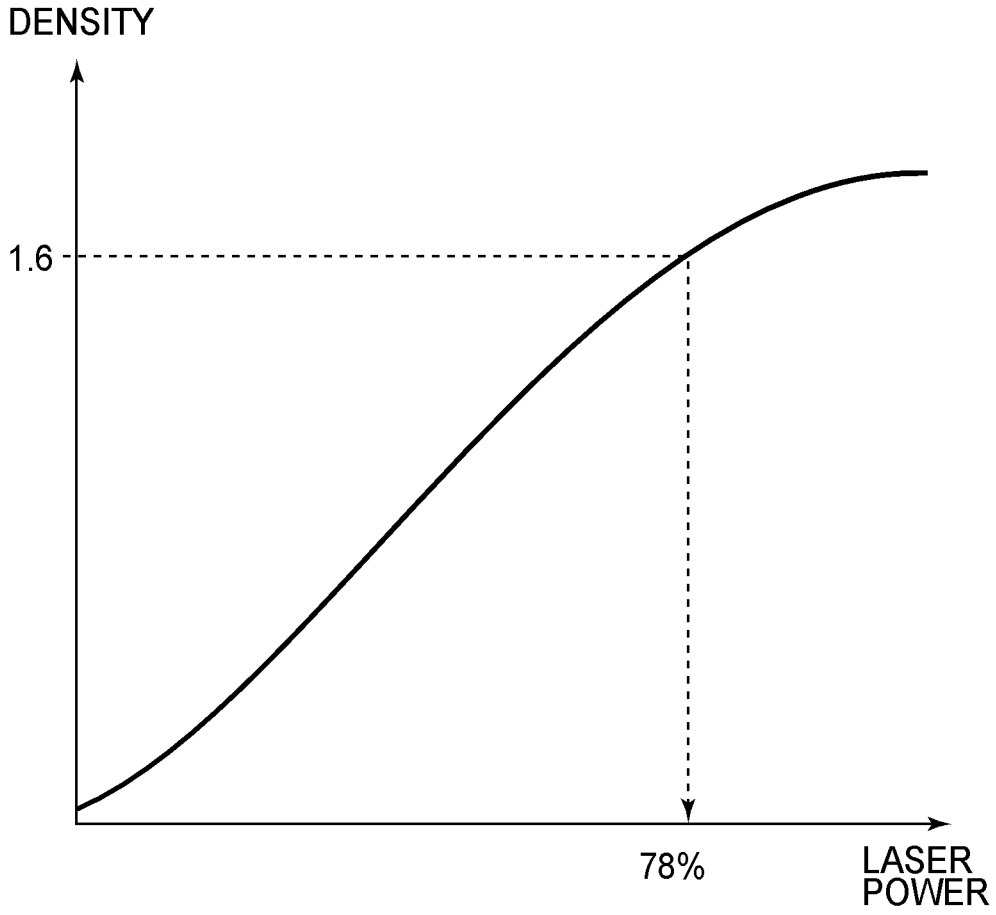
FIG. 11 is a graph showing a relationship between laser power and the density.
Figure 12:
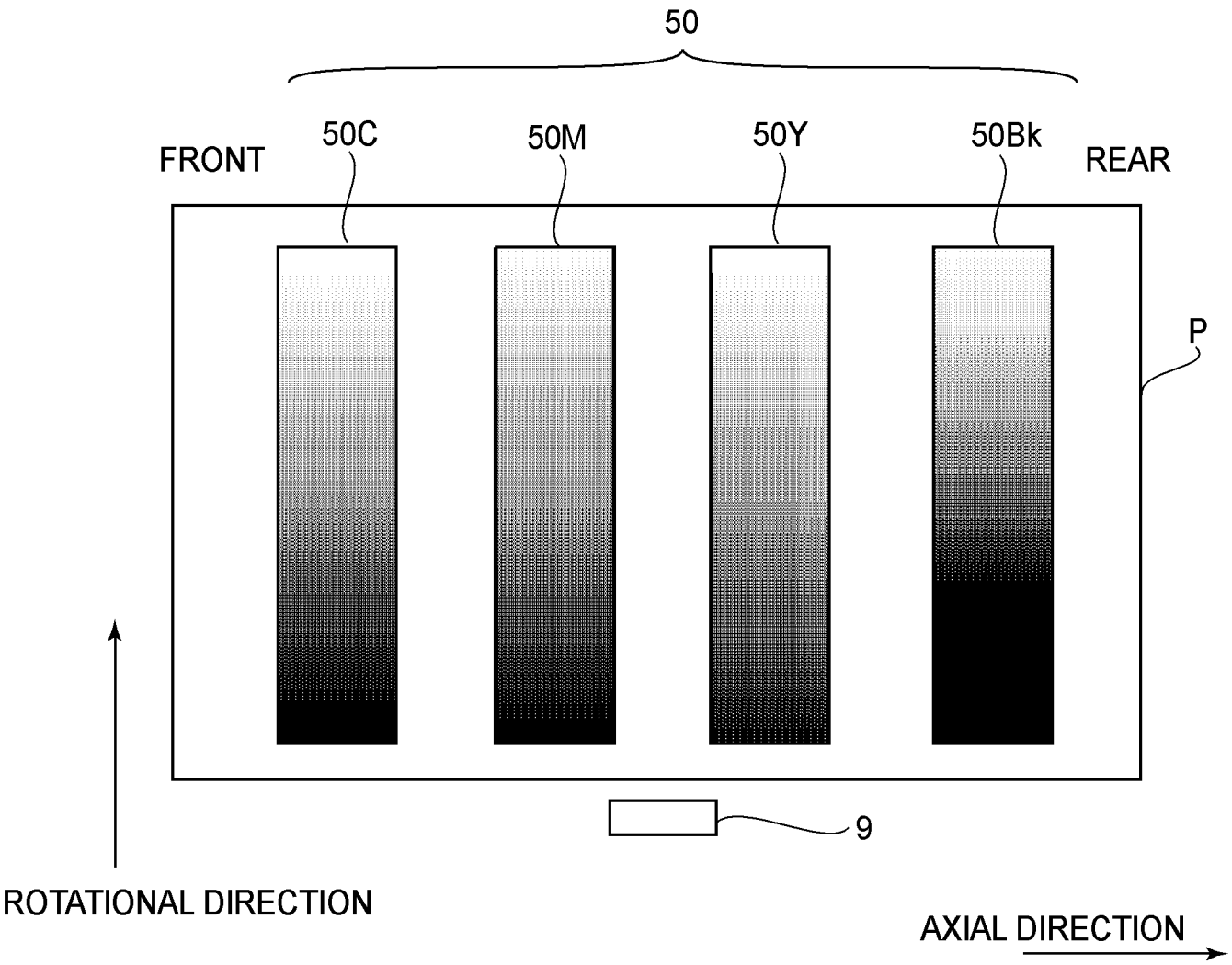
FIG. 12 is a plan view showing conventional adjusting image patterns.

At the color stations, a relationship between laser power and density as shown in FIG. 11 is obtained from the laser power set during the latent image formation in S103 and the density read in S106 (S109). Similarly as in the case of the black, when the density is intended to be 1.6, the corresponding laser power is 78%, so that the image forming controller 14 sets and stores the laser power of 78% (S110 and S111).

FIG. 2(*b*) is a flow chart showing the automatic density adjustment by the image density correcting means 14*b*. As shown in FIG. 2(*b*), the image density correcting means 14*b* is actuated with arbitrary set timing such as after output of a predetermined number of sheets or at the time of electric power on (S201).

The image density correcting means 14*b* automatically starts control (S202). The image density correcting means 14*b* adjusts the charging amount or the exposure light amount while measuring the potential so as to coincide with the developing contrast calculated by the density condition deriving means 14*a* with respect to only the black (S203). The image density correcting means 14*b* sets the charging amount or the exposure light amount on the basis of the changed condition with respect to the colors (yellow, magenta and cyan). Then, the control by the image density correcting means 14*b* is ended (S204).

Figure 3:
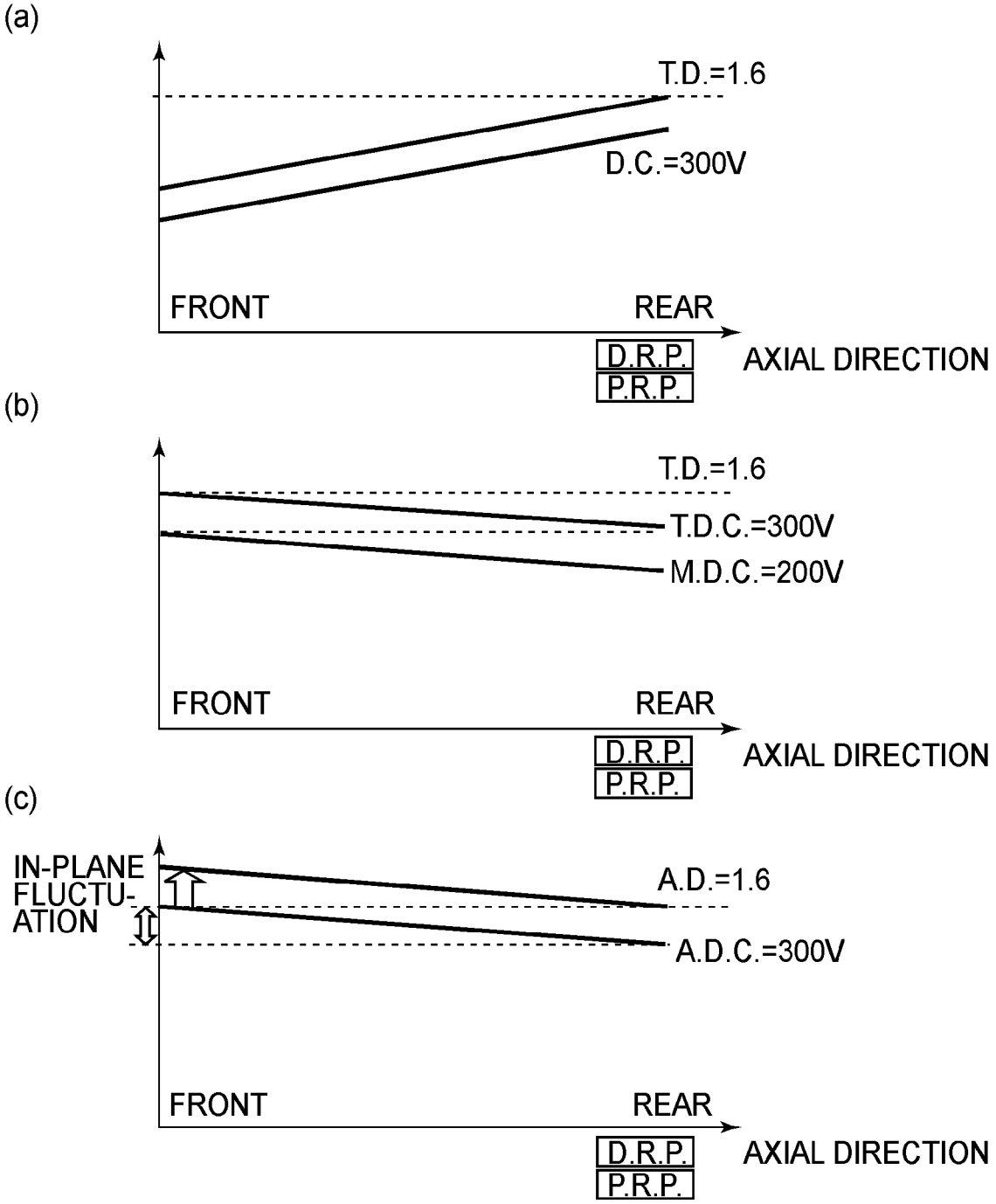
FIG. 3(*a*) is a graph showing a relationship between an image pattern density and a developing contrast with respect to a position of an axial direction of a photosensitive drum in the case where the density condition deriving means is controlled, FIG. 3(*b*) is a graph showing a relationship between the image pattern density and the developing contrast with respect to the position of the axial direction of the photosensitive drum in the case where the potential is changed with time or the like, and FIG. 3(*c*) is a graph showing a relationship between the image pattern density and the developing contrast with respect to the position of the axial direction of the photosensitive drum in the case where the image density adjusting means is controlled.

FIG. 3(*a*) is a graph showing a relationship between the density of the tone gradation pattern and the developing contrast of the photosensitive drum 1 at a predetermined position with respect to the axial direction of the photosensitive drum 1 in the case where the density condition deriving means 14*a* is used. As shown in FIG. 3(*a*), the case where a potential reading position (P.R.P.) of the potential sensor 9 and a density reading position (D.R.P.) of the original reading apparatus 100*a* are located at the same position, i.e., on the rear side with respect to the axial direction of the photosensitive drum 1 is assumed. Further, when the density condition is derived by the density condition deriving means 14*a* using the sheet P, the case where the potential of the black photosensitive drum 1Bk is inclined upwardly from the front side to the rear side of the photosensitive drum 1 with respect to the axial direction of the photosensitive drum 1 is assumed.

In the case where the target tone gradation pattern density is 1.6, the original reading apparatus 100*a* detects the adjusting tone gradation pattern density as 1.6 at the density reading position and the potential sensor 9 detects the developing contrast as 300 V at the potential reading position. At the same position with respect to the axial direction of the photosensitive drum 1, the adjusting tone gradation pattern density and the developing contrast of the photosensitive drum 1 become the target values.

FIG. 3(*b*) is a graph showing a relationship between the tone gradation pattern density and the developing contrast of the photosensitive drum 1 when a state is changed by a change in potential with time or the like. As shown in FIG. 3(*b*), the potential is inclined downwardly from the front side to the rear side since the user effects continuous formation of images different in image ratio with respect to the axial direction of the photosensitive drum 1 for a long period by the image forming apparatus. In this case, the adjusting tone gradation pattern density is detected as 1.4 at the density reading position and the developing contrast is detected as 200 V at the potential reading position. Since it is judged that the target developing contrast (T.D.C.) of 300 V is required with respect to the target density of 1.6, it is judged that values of the adjusting tone gradation pattern density and the developing contrast are insufficient on the rear side.

FIG. 3(*c*) is a graph showing a relationship between the tone gradation pattern density and the developing contrast with respect to the axial direction of the photosensitive drum 1 in the case where the image density correcting means 14*b* is used. As shown in FIG. 3(*c*), in the case where an actually measured developing contrast is 200 V, the image density correcting means 14*b* automatically effects control using the potential to increase the potential so that the developing contrast is increased to 300 V at the position of the potential sensor 9. As a result, the density on the rear side of the photosensitive drum 1 is accurately adjusted to 1.6, thus being in an acceptable range by the user although the front-side density is somewhat increased. As described above, by changing the potential sensor 9 depending on the adjusting tone gradation pattern to be measured, even when the conventional adjusting tone gradation pattern is used, it is possible to adjust the density with accuracy. Incidentally, the density and the developing contrast on the front side of the photosensitive drum 1 are higher than the target values but are within in-plane fluctuation ranges.

Figure 4:
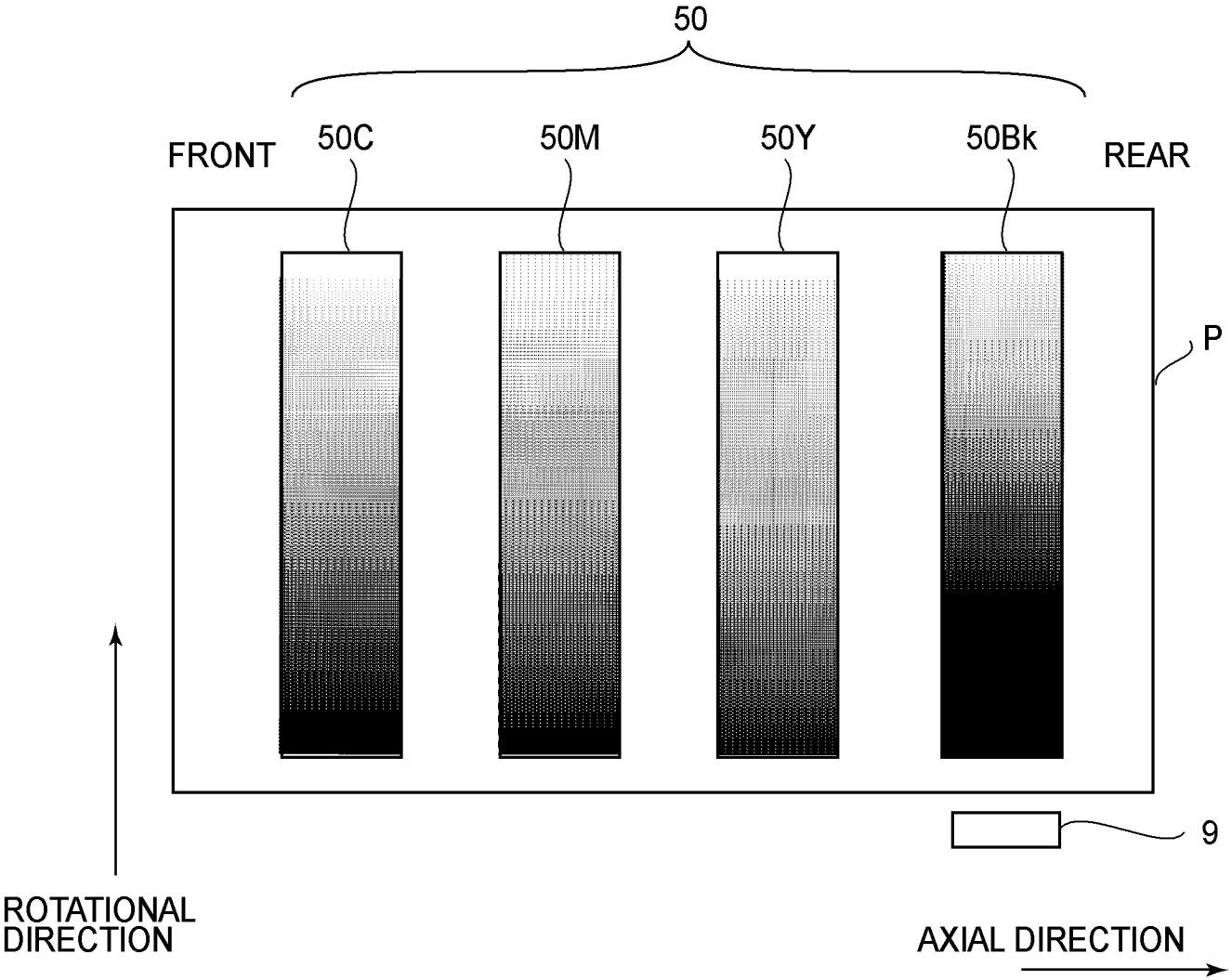
FIG. 4 is a plan view showing an example of adjusting image patterns.

FIG. 4 is a plan view showing an example of the adjusting tone gradation pattern formed on the sheet P. The case where the control by the density condition deriving means 14*a* is started by the operation by the user is assumed. The potential sensor 9 as the potential detecting means is capable of detecting the potential in a part of an area of the black photosensitive drum 1Bk with respect to the photosensitive drum axial direction over the circumferential direction in order to adjust the potential of the black photosensitive drum 1Bk.

The image forming apparatus 100 outputs the adjusting tone gradation pattern as the tone gradation pattern which includes patterns of cyan, magenta, yellow and black arranged in this order from the front side of the photosensitive drum 1 with respect to the axial direction of the photosensitive drum 1 and each color is changed from dark color tone to light color tone with respect to the rotational direction of the photosensitive drum 1 (FIG. 4). Incidentally, hereinafter, a cyan adjusting tone gradation pattern is represented by 50C, a magenta adjusting tone gradation pattern is represented by 50M, a yellow adjusting tone gradation pattern is represented by 50Y, and a black adjusting tone gradation pattern is represented by 50Bk. However, a constitution common to all the adjusting tone gradation patterns will be described by using an adjusting tone gradation pattern 50.

The position in which the black adjusting tone gradation pattern 50Bk is formed substantially coincides with the position of the potential sensor 9 with respect to the axial direction of the photosensitive drum 1. At this time, the charge potential is uniformly set at −600 V and the DC component of the developing bias is set at −450 V. By changing the laser power of the exposure device 17, the black adjusting tone gradation pattern 50Bk is formed. Further, at the black station, the formed pattern is subjected to measurement of the potential with the potential sensor 9. In this case, only the adjustment by changing the condition for the exposure device 17 as the exposure means but it is also possible to perform adjustment by changing the condition for the charging device 2 as the charging means or for the developing device 4 as the developing means.

The user places the adjusting tone gradation pattern, output by the instructions by the image forming apparatus 100, on the original reading apparatus 100*a* and provides instructions to perform reading adjustment. The image forming apparatus 100 measures the density of the read adjusting tone gradation pattern. Now, it is assumed that the density is intended to be adjusted to 1.6 by the image forming apparatus 100. At the black station, the above-described relationship between the potential an the density is obtained to calculate the developing contrast necessary to provide an arbitrary density. The potential of the adjusting tone gradation pattern is directly read, so that it is possible to accurately obtain the necessary developing contrast without being influenced by the charging non-uniformity due to the eccentricity of the photosensitive drum 1 or by the sensitivity non-uniformity of the photosensitive layer with respect to the rotational direction of the photosensitive drum 1.

FIG. 5 is a graph showing a relationship between the developing contrast (Vcont) and the density. As shown in FIG. 5, the developing contrast corresponding to the density of 1.6 is 300 V, so that the image forming apparatus 100 stores this value.

Figure 7:
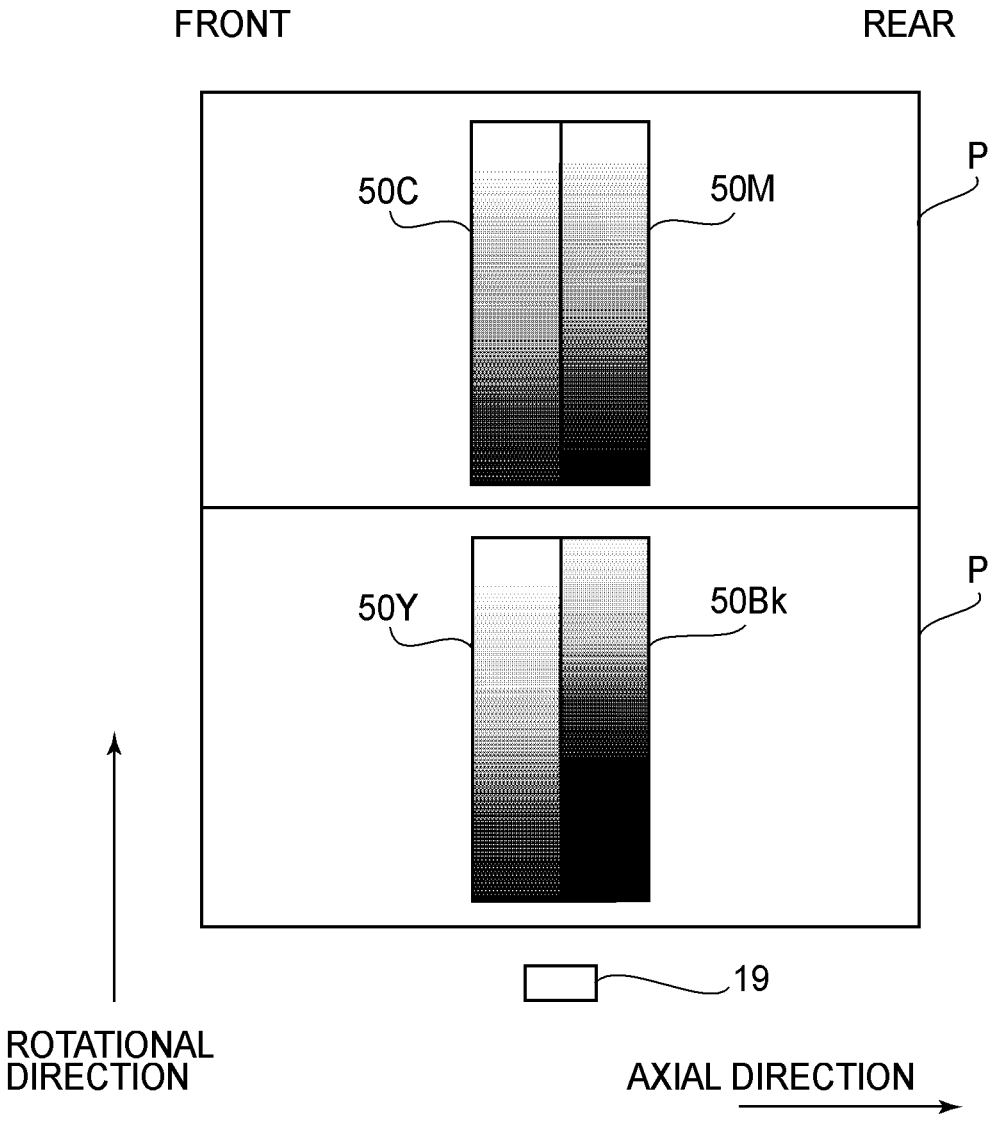
FIG. 7 is a plan view showing conventional adjusting image patterns.

FIG. 7 is a plan view showing arrangement of a conventional adjusting tone gradation pattern 50. As shown in FIG. 7, in the conventional pattern, adjusting tone gradation patterns for all the colors (including black) are arranged correspondingly to the position of the potential sensor 19, so that, e.g., one sheet of A3-sized paper or two sheets of A4-sized paper has been needed.

Figure 6:
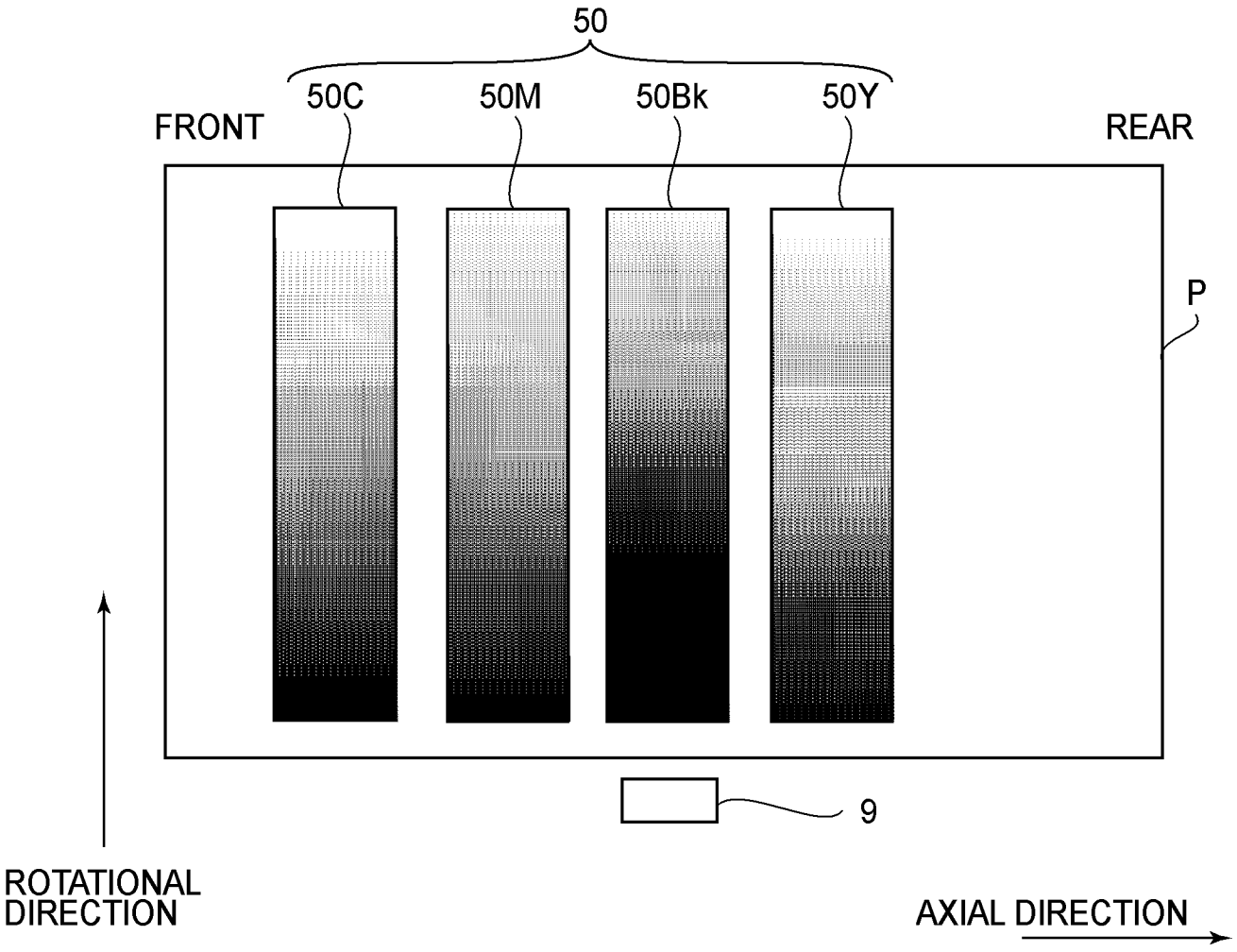
FIG. 6 is a plan view showing another example of the adjusting image patterns.

FIG. 6 is a plan view showing another example of arrangement of the adjusting tone gradation pattern 50 in the present invention. As shown in FIG. 6, the respective adjusting tone gradation patterns can be arranged in parallel to each other with respect to the axial direction of the photosensitive drum 1, so that an output time and the number of output sheets can be reduced compared with the conventional adjusting tone gradation pattern.

Further, as shown in FIG. 6, the potential sensor 9 may also be disposed at a central portion of the photosensitive drum 1 with respect to the axial direction of the photosensitive drum 1. Specifically, with respect to the axial direction of the photosensitive drum 1, the cyan adjusting tone gradation pattern 50C, the magenta adjusting tone gradation pattern 50M, the black adjusting tone gradation pattern 50Bk, and the yellow adjusting tone gradation pattern 50Y are arranged in this order from the front side. With respect to the rotational direction of the photosensitive drum 1, each cyan is gradually changed in one from dark to light. At the black position, the black adjusting tone gradation pattern located at the same position as that of the potential sensor 9 with respect to the axial direction of the photosensitive drum 1 is output.

In this case, a slope of the potential varies, at a maximum level of ±30 V between the front side and the rear side and about ±0.2 as the density value between the front side and the rear side, depending on adjusting accuracy of the charging device and a manner of use by the user. In the case where the potential sensor 9 is located at an end portion on the rear side (FIG. 4), the rear-side density is adjusted accurately to 1.6 by the potential adjustment (the adjustment by the image density correcting means 14*b*) but the front-side density is 1.8 at the maximum. On the other hand, in the case where the potential sensor 9 is disposed at the central portion (FIG. 6), a distance from the potential sensor 9 to a most distant position is half of that in the case of the potential sensor 9 in FIG. 4, so that the difference in density from that at the central portion if 10.1 at the maximum. Therefore, it is possible to suppress the density in the range of 1.5 to 1.7 in the entire area with respect to the axial direction of the photosensitive drum 1.

Incidentally, in this embodiment, the position of the potential sensor 9 and the position of the black adjusting tone gradation pattern 50Bk substantially coincide with (correspond to) each other with respect to the axial direction of the photosensitive drum 1 but the position relationship is not limited to this relationship. For example, even in the case where the positions of the potential sensor 9 and the black adjusting tone gradation pattern 50Bk are somewhat deviated from each other due to the arrangement of the potential sensor 9, tone gradation pattern formation, and other constraints, in order to achieve the effect, the black adjusting tone gradation pattern 50Bk may only be required to come nearer to the position of the potential sensor 9 than other adjusting tone gradation patterns for which the potential sensor 9 is not provided.

Figure 8:
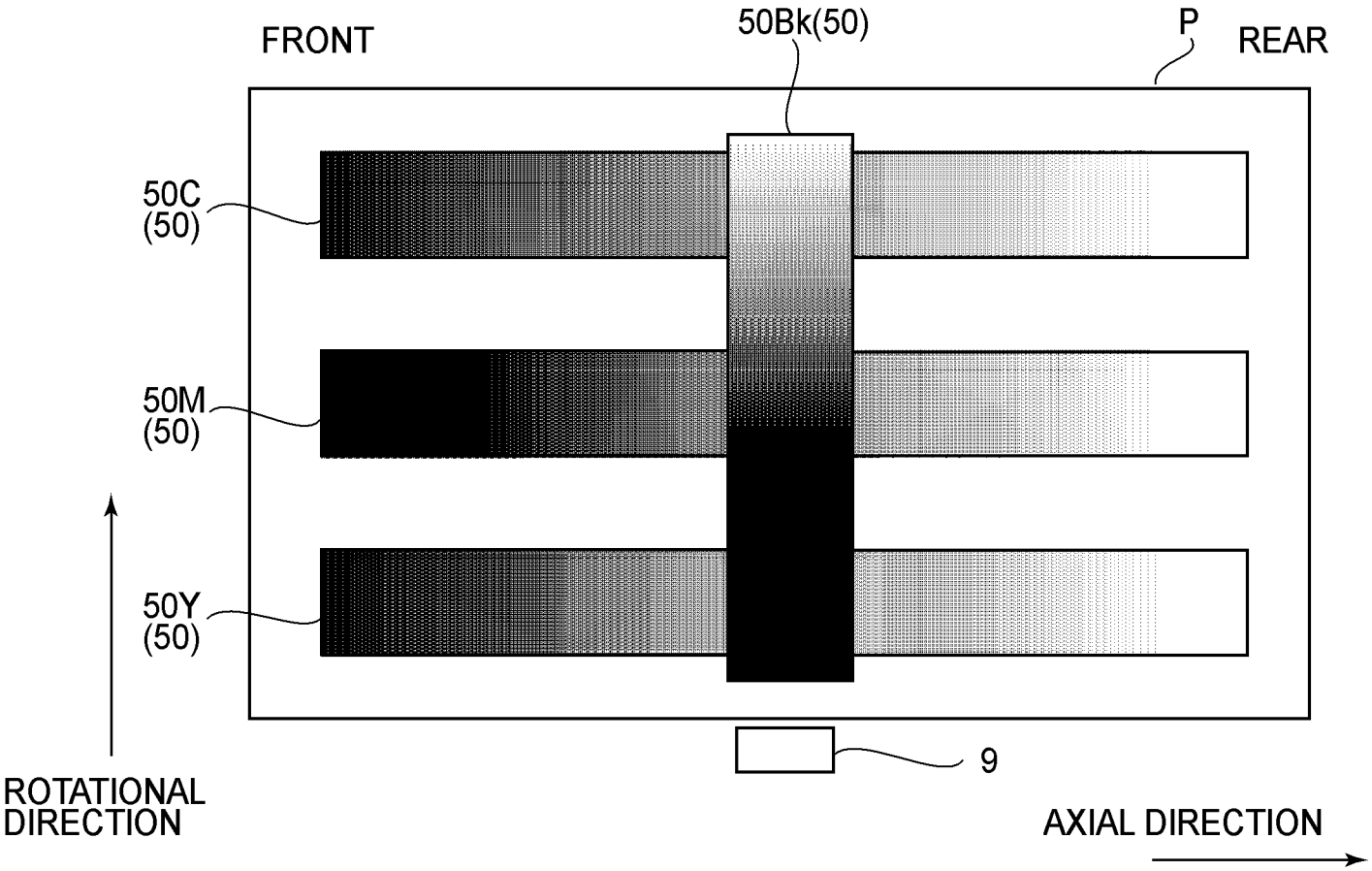
FIG. 8 is a plan view showing arrangement of adjusting image patterns including second adjusting image patterns extend in a direction perpendicular to a rotational direction of a photosensitive drum 1.

FIG. 8 is a plan view showing arrangement of the adjusting tone gradation patterns 50 arranged in the axial direction and the rotational direction of the photosensitive drum 1. As shown in FIG. 8, the cyan adjusting tone gradation pattern 50C, the magenta adjusting tone gradation pattern 50M, and the yellow adjusting tone gradation pattern 50Y may also be formed by the image forming controller 14 along a direction perpendicular to the conveyance direction of the sheet P. That is, the cyan adjusting tone gradation pattern 50C, the magenta adjusting tone gradation pattern 50M, and the yellow adjusting tone gradation pattern 50Y which are not provided with the potential sensor 9 may be extended in the axial direction of the photosensitive drum 1. Further, the black adjusting tone gradation pattern 50Bk may be extended in the rotational direction of the photosensitive drum 1.

Further, as shown in FIG. 8, the black adjusting tone gradation pattern 50Bk is disposed at the central portion of the sheet P with respect to the axial direction of the photosensitive drum 1 and the color tone of black is gradually changed from dark to light with respect to the rotational direction of the photosensitive drum 1. Further, the cyan, magenta and yellow adjusting tone gradation patterns are formed and extended in the axial direction of the photosensitive drum 1 so that each color tone is gradually changed from dark to light and are arranged in parallel to each other with respect to the rotational direction of the photosensitive drum 1. That is, the potential sensor 9 for measuring the potential on the photosensitive drum 1 is disposed at the substantially central position, with respect to the axial direction of the photosensitive drum 1, in which the potential in the black adjusting tone gradation pattern-formed area is measurable.

By employing the above-described constitution, it is possible to obtain the relationship between the laser power and the density without being influenced by the potential non-uniformity with respect to the rotational direction of the photosensitive drum 1. Further, the cyan, magenta and yellow adjusting tone gradation patterns are formed and extended in the photosensitive member axial direction so as not to be influenced by the surface potential non-uniformity of the photosensitive drum due to the eccentricity of the charging roller, so that it is possible to adjust the laser power with accuracy also with respect to the cyan, magenta and yellow adjusting tone gradation patterns.

Figure 9:
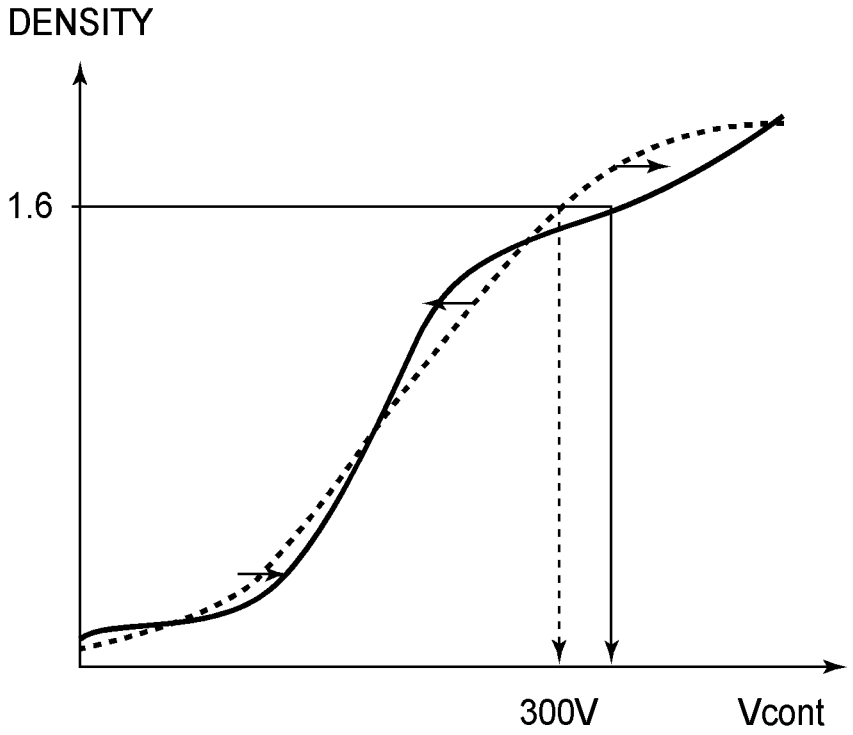
FIG. 9 is a graph showing a relationship between the developing contrast and the density.

FIG. 9 is a graph showing a relationship between the developing contrast and the density. Whether the black adjusting tone gradation pattern and the cyan, magenta and yellow adjusting tone gradation pattern 50C, 50M and 50Y are arranged in the axial direction of the photosensitive drum 1 or in the rotational direction of the photosensitive drum 1 is determined based on the following factor. The cyan, magenta and yellow stations employ the charging roller, so that the potential non-uniformity occurs with respect to the rotational direction of the photosensitive drum 1 as shown in FIG. 9. This is because the charging roller is a rotatable member, so that various types of non-uniformity such as dynamic fluctuation of an electric discharge area due to surface shape non-uniformity or eccentricity of the charging roller with respect to the rotational direction, electric discharge non-uniformity due to electric resistance non-uniformity, and non-uniformity of charging and photosensitive properties of the photosensitive drum occur. When the density condition deriving means 14*a* is controlled with the adjusting tone gradation patterns different in density with respect to the rotational direction of the photosensitive drum 1 in such a situation, the adjusting tone gradation patterns are formed with the developing contrast changed in different direction position by position in such a manner that an estimated developing contrast indicated by a dotted line is shifted to an actual developing contrast indicated by a solid line (FIG. 9). For that reason, accuracy is lowered when the relationship between the developing contrast (Vcont) and the density is obtained and in a worsen case, the relationship is inverted. Therefore, there is a possibility that a condition to be set cannot be obtained. In order to suppress such a phenomenon, the adjusting tone gradation patterns are arranged as shown in FIG. 8.

According to this embodiment, the image forming controller 14 forms the black adjusting tone gradation pattern 50Bk along the conveyance direction of the sheet P so that at least a part of the black adjusting tone gradation pattern 50Bk corresponds to the potential detecting area. Therefore, at the density reading position of the black adjusting tone gradation pattern 50Bk, the relationship between the potential detected by the potential sensor 9 and the density detected by the original reading apparatus 100*a* is accurately obtained. As a result, a density error of the black adjusting tone gradation pattern on the sheet P is reduced.

According to this embodiment, the potential sensor 9 is provided for the black photosensitive drum 1Bk but is not provided for the cyan photosensitive drum 1C, the magenta photosensitive drum 1M and the yellow photosensitive drum 1Y. In the conventional image forming apparatuses, the potential sensor is provided for all the photosensitive drums for all colors or is not provided for all the photosensitive drums for all colors. The black photosensitive drum 1Bk is generally used frequently, thus being required to have a long lifetime. When the potential sensor is not provided for all the photosensitive drums, downsizing of the image forming apparatus is liable to be realized. On the other hand, when the potential sensor is provided for all the photosensitive drums, the density error is liable to be controlled. As in the present invention, when the potential sensor 9 is provided for only the black photosensitive drum 1Bk, it is possible to meet both of the requirements described above.

According to this embodiment, all the black adjusting tone gradation pattern 50Bk, the cyan adjusting tone gradation pattern 50C, the magenta adjusting tone gradation pattern 50M, and the yellow adjusting tone gradation pattern 50Y may be formed and extended in the rotational direction of the photosensitive drum 1. Theses adjusting tone gradation patterns 50Bk, 50C, 50M and 50Y are arranged in a plurality of lines in the axial direction of the photosensitive drum 1 (FIG. 4). Therefore, a time and the number of sheets required to output the adjusting tone gradation patterns are reduced. Further, with respect to the axial direction of the photosensitive drum 1, non-uniformity of at least the black adjusting tone gradation pattern 50Bk formed by the black photosensitive drum 1Bk is reduced, so that accuracy of the density adjustment. Incidentally, in the conventional image forming apparatus, all the adjusting tone gradation patterns for all colors are arranged correspondingly to the potential sensor 19, so that these patterns have to be arranged in not only the axial direction of the photosensitive drum 1 but also the rotational direction of the photosensitive drum 1 (FIG. 7). Due to such an arrangement of the adjusting tone gradation patterns in the rotational direction of the photosensitive drum 1, the time and the number of sheets required to output the adjusting tone gradation patterns are increased in the conventional image forming apparatus.

According to this embodiment, the black adjusting tone gradation pattern 50Bk may be formed and extended in the rotational direction of the photosensitive drum 1. Therefore, the potential non-uniformity of the photosensitive drum 1 with respect to the rotational direction of the photosensitive drum 1 can be met by the potential sensor 9. Further, the cyan adjusting tone gradation pattern 50C, the magenta adjusting tone gradation pattern 50M, and the yellow adjusting tone gradation pattern 50Y have a longitudinal direction parallel to the axial direction of the photosensitive drum 1. Therefore, the influence of the potential non-uniformity of the photosensitive drum 1 with respect to the rotational direction of the photosensitive drum 1 is reduced. Thus, the density adjustment is improved in accuracy.

In the present invention, the black photosensitive drum 1Bk corresponds to the first photosensitive member and the black adjusting tone gradation pattern 50Bk corresponds to the first adjusting tone gradation pattern but the present invention is not limited thereto. For example, as the first photosensitive member, it is also possible to use any one or a plurality of the cyan photosensitive drum 1C, the magenta photosensitive drum 1M and the yellow photosensitive drum 1Y. Further, as the first adjusting tone gradation pattern, it is also possible to use any one or a plurality of the cyan adjusting tone gradation pattern 50C, the magenta adjusting tone gradation pattern 50M and the yellow adjusting tone gradation pattern 50Y. In these cases, as the second photosensitive member and the second adjusting tone gradation pattern, the photosensitive drums other than the first photosensitive member and the adjusting tone gradation patterns other than the adjusting tone gradation pattern are used.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 217888/2008 filed Aug. 27, 2008 and 157026/2009 filed Jul. 1, 2009, which is hereby incorporated by reference.

What is claimed is:

1. An image forming apparatus comprising:

a first toner image forming unit configured to form a toner image, said first toner image forming unit including a first rotatable photosensitive member, a corona charger configured to charge said first rotatable photosensitive member, a first exposing portion configured to form an electrostatic image on a surface of said first rotatable photosensitive member by exposing said first rotatable photosensitive member charged by said corona charger, a first developing device configured to develop with toner the electrostatic image formed on said first rotatable photosensitive member, and a surface potential sensor for detecting a surface potential of said first rotatable photosensitive member, for a part of a longitudinal range of said first rotatable photosensitive member;

a second toner image forming unit configured to form a toner image, said second toner image forming unit including a second rotatable photosensitive member, a charging roller configured to charge said second rotatable photosensitive member, a second exposing portion configured to form an electrostatic image on a surface of said second rotatable photosensitive member by exposing said second rotatable photosensitive member charged by said charging roller, and a second developing device configured to develop with toner the electrostatic image formed on said second rotatable photosensitive member;

a transferring device configured to transfer onto a sheet the toner image formed on said first rotatable photosensitive member by said first toner image forming unit and the toner image formed on said second rotatable photosensitive member by said second toner image forming unit;

a tone gradation pattern forming unit configured to form a first tone gradation pattern having a plurality of different tone gradations by said first toner forming unit, form a second tone gradation pattern having a plurality of different tone gradations by said second toner forming unit, and to transfer the first tone gradation pattern and the second tone gradation pattern onto the same sheet by said transferring device;

a density detecting unit configured to detect a density of the first and second tone gradation patterns formed on the sheet; and a correcting unit configured to correct an image forming condition of said first toner image forming unit on the basis of outputs of said density detecting unit and said surface potential sensor, and to correct an image forming condition of said second toner image forming unit on the basis of an output of said density detecting unit without taking a surface potential of said second photosensitive member into account, wherein said tone gradation pattern forming unit forms the first tone gradation pattern having a longitudinal direction which is along a circumferential direction of said first photosensitive member so that at least a part, in an axial direction of said first photosensitive member, of the first tone gradation pattern overlaps a potential detecting region of said surface potential sensor and that the tone gradations change in the circumferential direction of said first rotatable photosensitive member, and said tone gradation pattern forming unit forms the second tone gradation pattern having a longitudinal direction which is along an axial direction of said charging roller so as to have the tone gradations change in the axial direction of said charging roller.

2. The apparatus according to claim 1, wherein said correcting unit corrects the image forming condition of said first toner image forming unit on the basis of a bias applied to said first developing device to form the first tone gradation pattern.

3. The apparatus according to claim 1, further comprising a reading unit, functioning as said density detecting unit, that reads an image formed on the sheet.

4. An image forming apparatus comprising:

a first toner image forming unit for forming a black toner image, said first toner image forming unit including a first rotatable photosensitive member, a corona charger configured to charge said first rotatable photosensitive member, a first exposing portion configured to form an electrostatic image on a surface of said first rotatable photosensitive member by exposing said first rotatable photosensitive member charged by said corona charger, a first developing device configured to develop with toner the electrostatic image formed on said first rotatable photosensitive member, and a surface potential sensor for detecting a surface potential of said first rotatable photosensitive member, for a part of a longitudinal range of said first rotatable photosensitive member;

second toner image forming units for forming yellow, magenta and cyan toner images, respectively, said second toner image forming units each including a second rotatable photosensitive member, a charging roller configured to charge said second rotatable photosensitive member, a second exposing portion configured to form an electrostatic image on a surface of said second rotatable photosensitive member by exposing said second rotatable photosensitive member charged by said charging roller, and a second developing device configured to develop with toner the electrostatic image formed on said second rotatable photosensitive member;

a transferring device configured to transfer onto a sheet the toner image formed on said first rotatable photosensitive member by said first toner image forming unit and the toner images formed on said second rotatable photosensitive members by said second toner image forming units;

a tone gradation pattern forming unit configured to form a black tone gradation pattern having a plurality of different tone gradations by said first toner forming unit, form yellow, magenta and cyan tone gradation patterns having a plurality of different tone gradations by said second toner forming units, and to transfer the black tone gradation pattern and the yellow, magenta and cyan tone gradation patterns onto the same sheet by said transferring device;

a density detecting unit configured to detect densities of the black, yellow, magenta and cyan tone gradation patterns formed on the sheet; and a correcting unit configured to correct an image forming condition of said first toner image forming unit on the basis of outputs of said density detecting unit and said surface potential sensor, and to correct an image forming condition of said second toner image forming units on the basis of an output of said density detecting unit without taking a surface potential of said second photosensitive members into account, wherein said tone gradation pattern forming unit forms the black tone gradation pattern having a longitudinal direction which is along a circumferential direction of said first photosensitive member so that at least a part, in an axial direction of said first photosensitive member, of the first tone gradation pattern overlaps a potential detecting region of said surface potential sensor and that the tone gradations change in the circumferential direction of said first rotatable photosensitive member, and said tone gradation pattern forming unit forms the yellow, magenta and cyan tone gradation patterns having a longitudinal direction which is along an axial direction of said charging rollers so as to have the tone gradations change in the axial direction of said charging rollers.

* * * * *